US006220048B1

(12) United States Patent
Finan, Sr. et al.

(10) Patent No.: US 6,220,048 B1
(45) Date of Patent: Apr. 24, 2001

(54) FREEZE DRYING WITH REDUCED CRYOGEN CONSUMPTION

(75) Inventors: Donald Stuart Finan, Sr., Palos Park, IL (US); Alan Tat Yan Cheng, Livingston, NJ (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/157,526

(22) Filed: Sep. 21, 1998

(51) Int. Cl.[7] ..... F25D 17/02
(52) U.S. Cl. ..... 62/434
(58) Field of Search ..... 62/434, 51.1; 34/284, 34/287, 289, 301

(56) References Cited

U.S. PATENT DOCUMENTS 5,456,084 10/1995 Lee ..... 62/51.1
5,519,946 5/1996 Renzi ..... 34/239
5,761,924 * 6/1998 Peckjian ..... 62/292

* cited by examiner

*Primary Examiner*—Corrine McDermott
*Assistant Examiner*—Malik N. Drake
(74) *Attorney, Agent, or Firm*—Bernard Lau

(57) ABSTRACT

A method and apparatus for controlling the temperature of a freeze drying chamber shelves and chamber in a refrigeration system having a condenser operatively associated therewith using the circulation of a cryogen through the condenser and of a cryogenically cooled heat transfer fluid through the chamber shelves for controlling the temperature therein, and also where the temperature of the cryogenically cooled heat transfer fluid having been regulated by an exchange of heat with the cryogen.

22 Claims, 2 Drawing Sheets

FREEZE DRYING WITH REDUCED CRYOGEN CONSUMPTION

FIELD OF THE INVENTION

This invention relates to freeze drying, and more particularly, to a method and apparatus for improving the precision and efficiency of freeze drying using a reduced amount of cryogen consumption.

BACKGROUND OF THE INVENTION

Cryogenic heat exchanger are attractive design alternatives from the standpoint that they do not use environmentally damaging refrigerants, but instead use a cryogenic heat transfer fluid such as a liquefied atmospheric gas.

Previous work in this area does not address the issue of making efficient use of cryogens. In many cases, the temperature and energy requirements of the cryogen and/or other coolant fluids, heat exchanging apparatuses and heat storage apparatuses do not match, thus causing inefficiencies in the freeze drying method and apparatus.

There has been an attempt to ensure the equal heat distribution in the water-ice condenser which leads to the freeze drying chamber. In U.S. Pat. No. 5,456,084 to Ron Lee, an attempt is provided for a cryogenic heat exchange system in which water-ice build-up on a condenser heat exchanger surface employed in the cryogenic heat exchanger system is more uniform as compared to that of the then prior art heat exchangers which utilize a cryogenic heat exchange fluid. In that sense, attempts were made to provide better control over the temperature in which the heat transfer using the cryogenic heat exchanger system takes place.

In U.S. application Ser. No. 08/709,027 filed Sep. 6, 1996 entitled "Method and Apparatus for Controlling Freeze Drying Process", which is incorporated herein by reference, there is provided a method and process which utilizes a single heat exchanger, cooled by a cryogenic refrigerant, to deliver cold heat transfer fluid directly to a condenser and, independently, to a freeze dryer or other refrigeration system, either directly or through a heater circuit, for cooling or heating the freeze dryer.

Notwithstanding the above, there is a need in the art for a method and apparatus to refrigerate the chamber shelves and water condenser of a freeze drying chamber utilizing a dispensable cryogen (primarily liquid nitrogen) and to allow the exhaust/waste gas from the cryogen supply to exit from the system at the warmest temperature possible, while at the same time, accomplishing with minimal pumping energy thereby for completing each freeze drying cycle with minimal refrigeration cost.

OBJECTS OF THE INVENTION

It is therefore an object of the invention to provide a method for improving the matching of the condenser cooling demands with the low demands of the cryogenically cooled heat transfer fluid in the art.

Another object of this invention is to provide a method and apparatus to store excess refrigeration with the heat transfer fluid.

Yet another object of this invention is to provide a method and apparatus for supplying cryogen directly to vacuum condensers to achieve lower temperatures.

Another object of this invention is to provide a method and apparatus for recycling cold gas from the condensers for increased operating efficiency.

Another object of this invention is to provide a method and apparatus for condensing a refrigerant that does not require the mechanical compression and expansion.

SUMMARY OF THE INVENTION

As will be discussed hereinafter, the present invention provides a method and apparatus for improving the match of the condenser cooling demands with the varying demands of the cryogenically cooled heat transfer fluid to that which have been found in the art. This matching of cooling demands during a programmed freeze dry recipe provides a more efficient utilization of the cryogen. The freeze dry cycle process typically includes 1) temperature ramp-down; 2) temperature soak; 3) vacuum induction; and 4) temperature ramp-up. This process will contain heat loads that vary by factors of at least 2:1, and can most economically be handled by choosing the pump and heat exchanger combination that will best fit the heat load. The freeze chamber and shelves must operate at a warmer temperature than the condenser. Therefore, a heater is usually used even during the cool down cycle to form a second heat transfer fluid recirculating loop. Such a process produces a high energy waste. This invention avoids the use of a heater during the cool down cycle, thus improving the efficiency. This selection method prevents the physically larger equipment from operating when not needed, thereby preventing large static and dynamic heat leaks, and allowing the smaller pumps/heat exchangers to handle the smaller heat loads more precisely and efficiently.

This invention is directed to a method for controlling the temperature of freeze drying chamber shelves and chamber in a refrigeration system having a condenser operatively associated therewith. This is done by circulating a cryogen through the condenser and circulating a cryogenically cooled heat transfer fluid through the chamber shelves for controlling the temperature therein. The temperature of the cryogenically cooled heat transfer fluid is regulated by an exchange of heat with the cryogen. The temperature of the cryogenically cooled heat transfer fluid is regulated by the exchange of heat with the cryogen through a plurality of heat exchangers, and further by a heating unit. Circulation of the cryogenically cooled heat transfer fluid is accomplished by using a plurality of pumps and valves. At the beginning of a temperature ramp down cycle, the temperature of the heat transfer fluid is first regulated by passing the heat transfer fluid through a precooling medium. At the middle of the ramp down cycle, the temperature is then regulated by passing the cooled heat transfer fluid through a second heat exchanger cooled with a cryogen. A refrigeration recovery unit may be used to maintain the temperature and to recycle the cryogenically cooled heat transfer fluid. A liquid refrigerant may also pass through the condenser.

This invention is also directed to a method for freeze drying by providing a freeze drying chamber having a condenser operatively associated therewith, circulating a cryogen through the condenser, and circulating a cryogenically cooled heat transfer fluid through the chamber shelves for controlling the temperature therein. The temperature of the cryogenically cooled heat transfer fluid is regulated by an exchange of heat with the cryogen.

This invention is also directed to a freeze drying apparatus comprising a freeze drying chamber for subjecting substances to a freeze drying process in which moisture or solvent contained within the substances is frozen and sublimed into a vapor, a series of shelves within the chamber, a condenser operatively associated with the freezing chamber for freezing the vapor and for accumulating the vapor in solid form. The condenser has at least one pass for receiving a cryogen for freezing the vapor. A plurality of heat exchangers is used to exchange heat between the cryogen and a cryogenically cooled heat transfer fluid. A cryogenically cooled heat transfer fluid circuit in which the temperature of the cryogenically cooled heat transfer fluid is regulated by the plurality of heat exchangers, and in which the cryogenically cooled heat transfer fluid passes through the freeze drying chamber to freeze a substance by separating at least a portion of liquid therefrom. The cryogen circuit in which the cold of the cryogen is transferred to the cryogenically cooled heat transfer fluid through the heat exchangers and the cryogen is passed through the condenser. A plurality of valve means regulates the flow of the cryogen, and at least one circulation means for circulating the cryogenically cooled heat transfer fluid through the cryogen circuit. During the initial part of the temperature ramp down cycle, the temperature of the heat transfer fluid is regulated by transferring cold to the heat transfer fluid by a precooling medium. During the temperature ramp up cycle, the temperature of the heat transfer fluid is regulated by passing the heat transfer fluid through a heating unit. A waste refrigeration recovery unit may be used to maintain the temperature and to recycle the cryogenically cooled heat transfer fluid. A liquid refrigerant circuit for feeding the condenser may be used.

For purposes of this invention, the term cryogen as used herein and in the claim means a substance existing as a liquid or solid at temperatures below those normally found in ambient, atmospheric conditions. Examples of cryogens are liquefied atmospheric gases, for instance, nitrogen, oxygen, argon, helium, carbon dioxide, etc.

The term low boiling point (LBP) refrigerant means a substance existing as a gas or vapor with boiling point below those normally found in ambient, atmospheric conditions. However, the LBP refrigerant can be readily condensed into a liquid upon heat exchange with a cryogen. For the purpose of this invention, the LBP refrigerant is selected so that the boiling point is the same as the operating temperature of the condenser. Examples of LBP refrigerants used in this invention include chloroform (b.p. −63.5° C.), ethane (b.p. −88.6° C.), dichlorofluoride (b.p. −78.4° C.), monochlorotrifluromethane (b.p. −114.6° C.) and other fluids that condense readily by heat exchange with a cryogen without compression but boils off into a gas or vapor when losing their refrigeration values. An example of the liquid refrigerant used in this invention is monochlorotrifluromethane.

The term cryogenically cooled heat transfer fluid is a material that is capable of transferring heat to and/or from another source of differing temperature. This fluid may be commercially available under the name of D'Limonene (available from Florida Chemical Co.), Lexsol (available from Santa Barbara Chemical Co.), or as silicone oil, a derivative of any of the above mentioned fluid, or other equally suitable fluid known to those skilled in the art.

BRIEF DESCRIPTION OF THE DRAWINGS

Other objects, features and advantages will occur to those skilled in the art from the following description of preferred embodiments and the accompanying drawings, in which.

DETAILED DESCRIPTION OF THE INVENTION

This invention may be accomplished by a method and apparatus as described by the figures.

A unique feature in this invention is the use of multiple heat exchangers to handle the heating and cooling cycle requirements typical of the freeze dryer. The heat transfer fluid passes through multiple heat exchangers to achieve the most efficient use of the energy in controlling the temperature of the freeze drying shelves and chamber.

Another aspect of the invention as shown in the figures is the unique use of the cryogen. In one sense, the cryogen is used as directly in the condenser (cold trap). In another sense, the cryogen is used as a primary coolant in the heat exchangers for regulating the temperature of the heat transfer fluid.

Yet another aspect is the improved efficiency through the sequential operation of various components of this invention. The novel use of the heat exchangers as shown by the possibility for passing a variety of coolant through the heat exchangers as well as the novel nature of the cryogen flow paths provide efficient use of resources.

As provided in FIG. 2 below, it is shown that a storage for heat transfer fluid (a refrigeration recovery unit) may be used to recover waste refrigeration and store excess refrigerant to meet cyclic refrigeration/heating demands.

Figure 2:
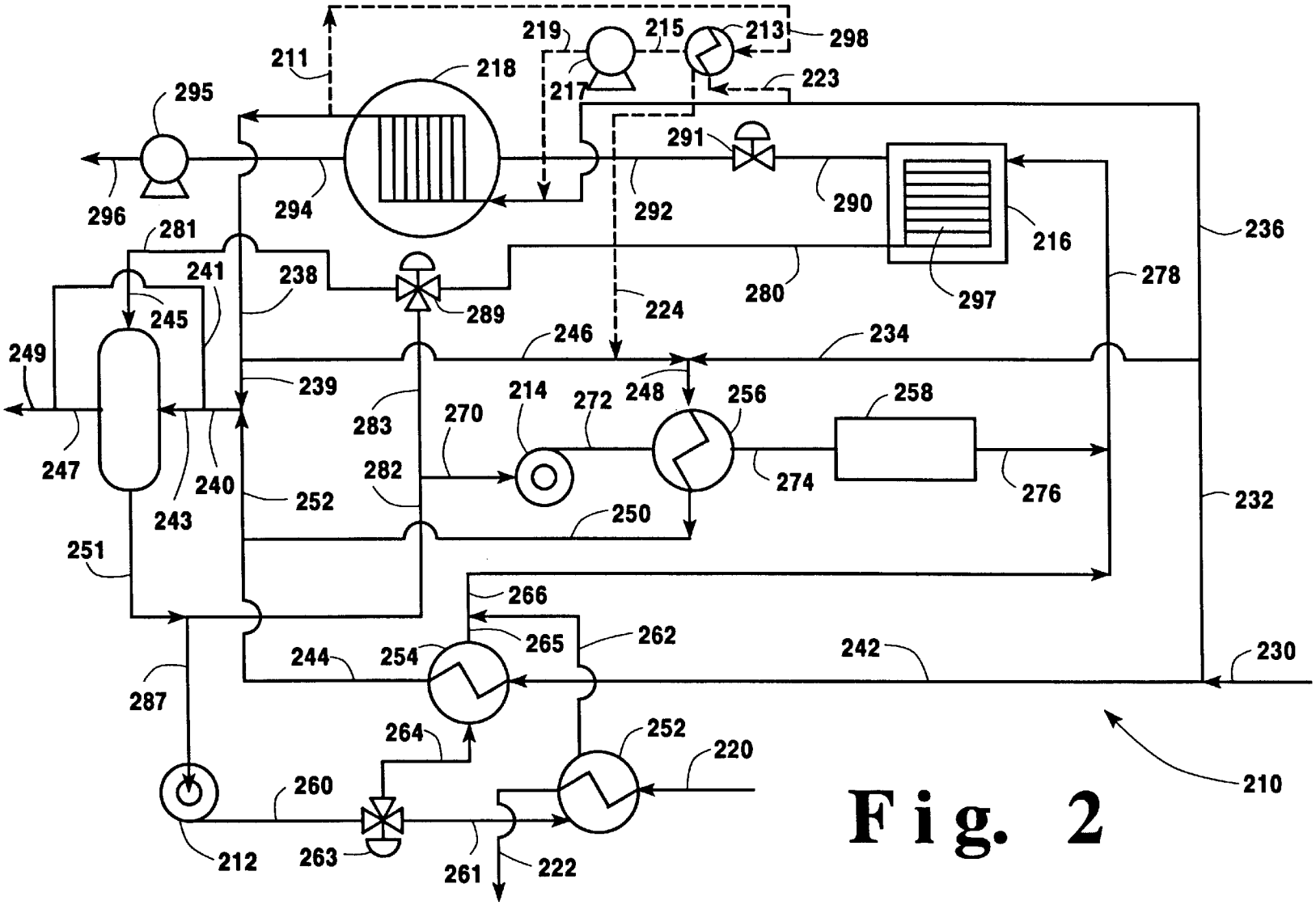
FIG. 2 is a schematic flow diagram illustrating the method and apparatus of FIG. 1 with the alternative embodiment of an additional refrigeration unit and the optional inclusion of a stream wherein a liquid refrigerant is passed through the condenser.

Also shown in FIG. 2 is the use of an alternate LBP refrigerant, such that the condensation and evaporation of the LBP refrigerant (subjected to heat exchange with the cryogen) alleviates the need for mechanical compression and expansion.

Figure 1:
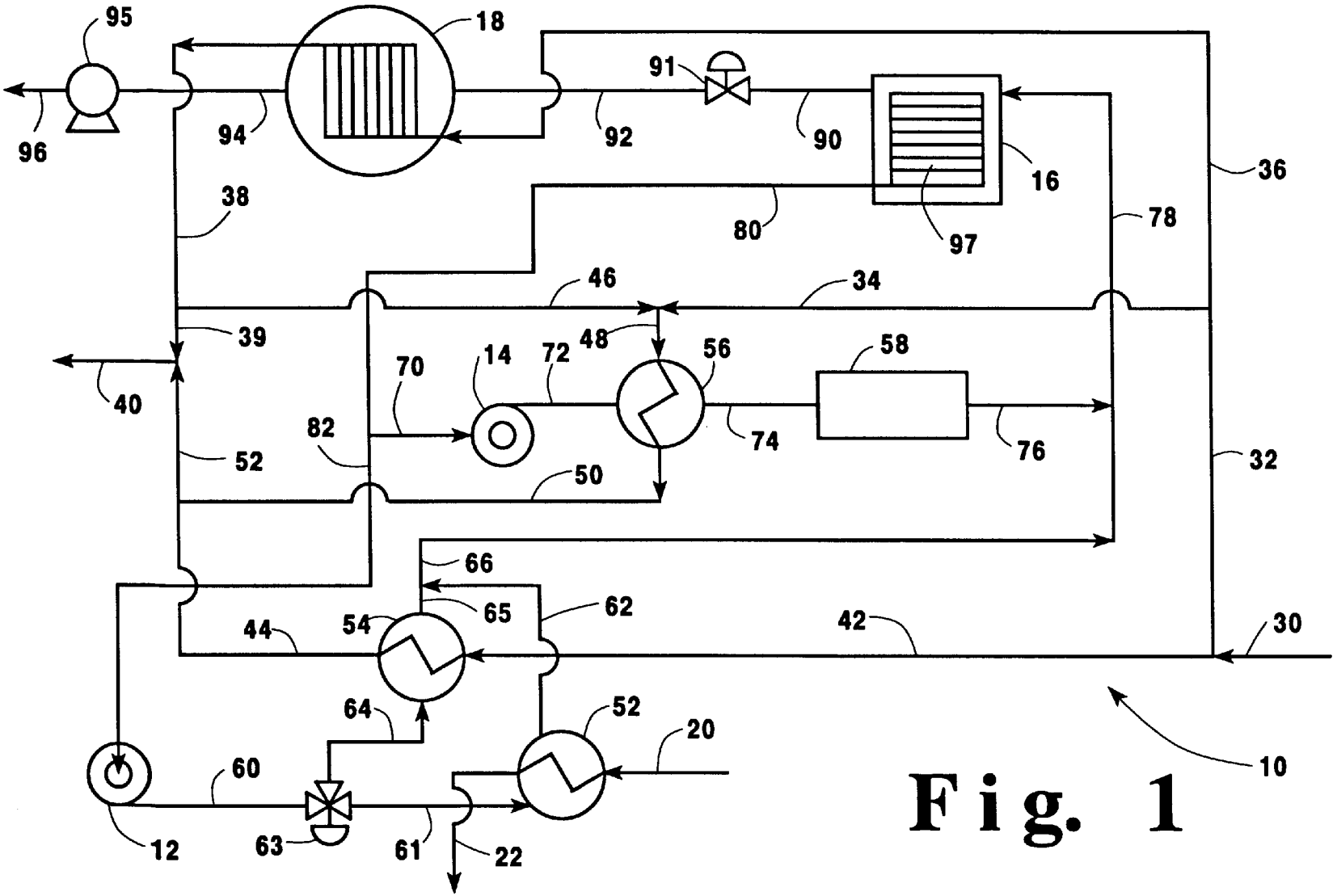
FIG. 1 is a schematic flow diagram illustrating the method and apparatus embodying the features of this invention.

With reference to the flow diagram of FIG. 1, refrigeration system 10 is provided. Precooling liquid 20 is passed through the inlet of heat exchanger 52 to emerge from its outlet as warmer precooling liquid 22. The precooling liquid may typically range from about 15° C. to about −40° C. Examples of precooling liquid may be a water cooler (in the temperature range of from about 1520 C. to about 2° C.) and glycol chiller (in the temperature range of from about 2° C. to about −40° C.).

Cryogen 30 is initially split into streams 32 and 42. Cryogen stream 42 passes through the inlet of heat exchanger 54 and emerges from its outlet as cryogen stream 44. Cryogen stream 32 is split into cryogen streams 34 and 36.

Cryogen stream 36 passes directly into the inlet of condenser (cold trap) 18 for cooling materials in the vapor phase to solid phase coming from the freezing chamber shelves 97 inside freezing chamber 16. Emerging from the outlet of condenser 18 is cryogen stream 38, which splits into cryogen streams 39 and 46. Cryogen stream 46 may combine with cryogen stream 34 to form combined cryogen stream 48, which is passed into the inlet of heat exchanger 56. Cryogen stream 50 emerges from the outlet of heat exchanger 56 and combines with cryogen stream 44 forming combined cryogen stream 52. Thereafter, cryogen streams 52 and 39 are combined to form combined cryogen stream 40, which passed as gaseous cryogen stream 40.

Cryogenically cooled heat transfer fluid stream 60 (the "cryogenically cooled heat transfer fluid" is hereinafter designated as "transfer fluid stream") is passed through the inlet of three-way electrically operated modulating control valve 64 by the activation of fluid pump 12. Transfer fluid streams 61 and 64 emerges from the outlets of three-way valve 63. During the start of the temperature ramp down cycle, stream 60 can be as hot as 80° C. (due to steam sterilization procedure). The three-way valve will activate and allow transfer fluid stream 61 to pass through heat exchanger 52 to emerge the outlet therefrom as cooler transfer fluid stream 62. When the temperature of the stream 60 reaches the range of 0° C. to −30° C., the three-way valve will activated again to allow only the other transfer fluid stream 64 to pass through the inlet of heat exchanger 54 emerging from the outlet as further cooled transfer fluid stream 65. It is contemplated that heat exchanger 52 provides the means for cooling the transfer fluid stream in a temperature range of from about 60° C. to about −30° C., and heat exchanger 54 provides the means for cooling the transfer fluid stream in a temperature range of from about 0° C. to about −90° C. In practice, the choice of operating either or both heat exchanger depends on the temperature of the transfer fluid 60 and the temperature cycle of the freeze drying process. The three-way control valve 63 can switch the flow from stream 60 to stream 61 or alternatively from stream 60 to stream 64. Cooled transfer fluid streams 62 and 64 are regulated alternatively to form fluid stream 66.

Transfer fluid stream 70, which had been partially recycled from freeze drying shelves 97 and chamber 16, passes through the inlet of heat exchanger 56 by the activation means of pump 14, to emerge through the outlet of heat exchanger 56 as transfer fluid stream 74, which in turn passes through the inlet of heating unit 58 to emerge the outlet therefrom as transfer fluid stream 76. The flow of heat transfer fluid streams 72, 74 and 76 is controlled primarily by the activation means of pump 14. Heat is supplied to heating unit 58 only during the temperature ramp-up cycle. During this cycle, heating unit 58 and pump 14 completely regulate the temperature by which the heat transfer fluid passes through the freeze drying shelves 97 and chamber 16. At this cycle, pump 12 will stop circulating the heat transfer fluid to the heat exchangers. During cool down cycle, heat transfer fluid streams 66 and 76 may combined to form heat transfer fluid stream 78 to direct to the inlet of the freeze drying shelves 97 and chamber 16 assembly. In practice, heat transfer fluid stream 78 passes through each of the freeze drying shelves 97 and chamber 16 to effectuate freeze drying of materials within freeze drying shelves 97 and chamber 16.

Emerging from the outlet of freeze drying shelves 97 and chamber 17 is exhausted transfer fluid stream 80, which in turn is separated into heat transfer fluid streams 70 and 82 for recycling. During the cool down and soak cycles, one of the transfer fluid stream 70 passes through the inlet of pump 14 to emerge through the outlet therefrom as transfer fluid stream 72 if pump 14 is activated. The other transfer fluid stream 82 passes through the inlet of pump 12 emerging from its outlet as transfer fluid stream 60.

Any frozen volatile substance will be vaporized through sublimation under high vacuum and is passed out of the freeze drying chamber 16 as stream 90. Emerging from the outlet of condenser 18 is the remaining waste stream 94 as it is drawn from vacuum pump 95. Waste stream 96 that emerges from the outlet of vacuum pump 95 is removed.

In general, the operation of the refrigeration system involves the use of a cryogen stream which passes directly to a condenser. Heat transfer fluid is cooled in sequence with a pre-cooled media and than cryogenically by the cryogen through a plurality of heat exchanger means, passed into the freeze drying shelves and chamber, and is recycled. The system provides for a particularly effective use of the cryogen for cooling the temperature of the heat transfer fluid, thus requiring the minimal amount of cryogen necessary to cool the heat transfer fluid and freeze dry the substances in the freeze drying shelves and chamber.

Since the freeze chamber 16 and shelves 97 must operate at a warmer temperature than the condenser 18, using the cryogen in the condenser 18 eliminate the need to turn on the heater 58 during the cooling cycle and to generate a separate heat transfer reciruclating loop. Therefore, the process is more efficient and less capital intensive.

Turning now to FIG. 2, there is shown an embodiment of system 210 wherein refrigeration recovery unit 245 is used to maintain the temperature and to recycle the heat transfer fluid. Also, a separate liquid LBP refrigerant system 298 provides a LBP refrigerant to pass through condenser 218.

Precooling liquid 220 is passed through the inlet of heat exchanger 252 to emerge as warmer precooling liquid 222. As discussed previously, precooling liquid 220 may be cooling water, glycol chiller or other similar liquid coolant for operation at a temperature of from about −40° C.

Cryogen 230 is initially split into streams 232 and 242. Cryogen stream 242 passes through the inlet of heat exchanger 254 and emerges the outlet therefrom as cryogen stream 244. Further, cryogen stream 232 is split into cryogen streams 234 and 236.

Cryogen stream 236 passes directly into a LBP refrigerant condenser 213. Emerging from the outlet of LBP refrigerant condenser 213 is cryogen stream 238, which splits into cryogen streams 239 and 246. During the cool down and soak cycles, cryogen stream 246 may combine with cryogen stream 234 to form combined cryogen stream 248, which is passed into the inlet of heat exchanger 256. Warmer cryogen stream 250 emerges from the outlet of heat exchanger 256 and combines with cryogen stream 244 forming combined cryogen stream 252. Cryogen streams 252 and 239 are combined to form combined cryogen stream 240, which in turn splits into cryogen streams 241 and 243. One of the cryogen stream 243 passes into the inlet of refrigeration recovery unit 245 and emerges as warmer cryogen stream 247. Therefore, waste refrigeration from stream 243 is recovered and stored. If the stream is warmer than the refrigeration recovery unit 245, e.g., during initial cool down or the heat transfer fluid becomes excessively cold (approaching its freezing point), the other cryogen stream 241 will bypasses refrigeration recovery unit 245 and may combine with cryogen stream 247 forming cryogen stream 249 for passing as wasted or gas storage.

Heat transfer fluid stream 260 passes into the inlet of three-way electrically operated modulating control valve 263 by the use of fluid pump 212. During the initial cool down and soak cycle, the three-way control valve will allow only transfer fluid streams 261 to emerge from the outlets of valve 263. Transfer fluid stream 261 passes through the inlet of heat exchanger 252 to emerge as cooler transfer fluid stream 262. When the temperature approaches the range of 0° C. to −30° C., the three-way control valve will then allow only the transfer fluid stream 264 to pass through the inlet of heat exchanger 254 emerging from the outlet thereof as further cooled transfer fluid stream 265. It is contemplated that heat exchanger 252 provides the means for cooling the transfer fluid stream in a temperature range of from about −5° C. to about 50° C., and that heat exchanger 254 provides the means for cooling the transfer fluid stream in a temperature range of from about 0° C. to about −80° C. In practice, the choice of operating either heat exchangers largely depends on the temperature cooling cycle of the freeze dryer, the temperature of the transfer stream 260, the type of cryogens and transfer fluid used in the system, and the flow of the transfer fluid streams through control valve 263. Cooled transfer fluid streams 262 and 264 may be combined to form fluid stream 266.

Transfer fluid stream 272, which is split from transfer fluid stream 280 emerging from the outlet of freeze drying shelves 297 and chamber 216, passes through the inlet of heat exchanger 256 using the activation means of pump 214, and emerges through the outlet of heat exchanger 256 as transfer fluid stream 274, which in turn passes through heating unit 258 to emerge from the outlet therefrom as transfer fluid stream 276. The flow of heat transfer fluid streams 272, 274 and 276 is controlled primarily by the activation of pump 214. Heat is supplied to the heating unit 258 only during the warm up or temperature ramp-up cycle of the freeze drying process. Heating unit 258 and pump 214 partially regulate the temperature by which the heat transfer fluid passes through the freeze drying shelves 297 and chamber 216.

During the cooling and soaking cycles, heat transfer fluid streams 266 and 276 are combined to form heat transfer fluid stream 278, which is directed to the inlet of the freeze drying shelves 297 and chamber 216 assembly. In practice, heat transfer fluid stream 278 passes through each of the freeze drying shelves 297 and chamber 216 to effectuate the freeze drying of materials within freeze drying shelves 297 and chamber 216.

Emerging from the outlet of freeze drying shelves 297 and assembly 216 is exhausted transfer fluid stream 280, which in turn is separated into heat transfer fluid streams 281 and 283 by the use of electrically operated modulating three-way control valve 289. Heat transfer fluid stream 283 splits into 270 and 282. Transfer fluid stream 270 passes through the inlet of pump 214 to emerge as transfer fluid stream 272 if the activation means of pump 214 is operational. The other transfer fluid stream 282 passes through the inlet of pump 212 emerging from its outlet as transfer fluid stream 260. During the cooling down and soaking cycles, heat transfer fluid stream 281 passes through the inlet of refrigeration recovery unit 245 and emerges from the outlet therefrom as heat transfer fluid stream 251. One of the heat transfer fluid streams 251 and 282 are joined to form heat transfer fluid stream 287.

Any frozen volatile substance is vaporized through sublimation and passed out of the freeze drying chamber 216 as stream 290. Emerging from the outlet of condenser 218 is the remaining waste stream 294 as it is drawn from vacuum pump 295. Waste stream 296 is removed when it emerges from the outlet of vacuum pump 295.

Additional refrigeration system 298 enables the use of a separate LBP refrigerant to lower the temperature of the condenser. LBP refrigerant 211, examples of which include those selected from the group consisting of a hydrocarbon and fluorocarbon based gases that can readily be condensed by a cryogen that boils off inside the condenser to provide a fixed cooling temperature. A preferred LBP refrigerant is monochlorotrifluromethane (Freon 13). LBP refrigerant gas 211 passes through the inlet of a LBP refrigerant condenser 213 and emerges through the outlet therefrom as liquefied cold LBP refrigerant 215, which then passes through pump 217 and exits the outlet of the pump as LBP refrigerant stream 219. LBP refrigerant stream 219 passes through the inlet of condenser 218 for removal of volatile substances from dry freezing shelves 297 and chamber 216. LBP refrigerant is boiled off inside condenser 218 to form gas LBP refrigerant 211.

In general, the operation of this second embodiment of the refrigeration system as provided in FIG. 2 involves the use of a refrigeration recovery unit as well as the use of a separate refrigerant for passing into the condenser. The refrigeration recovery unit recovers waste refrigeration from the vaporized cryogen and stores the excess refrigeration from the heat transfer fluid. The separate refrigerant enables the use of a conventional substance which can alleviate the need for certain compression and expanding apparatus and therefore, providing an efficient process.

Since the freeze chamber 216 and shelves 297 must operate at a warmer temperature than the condenser 218, using a LBP refrigerant in the condenser 218 eliminate the need to turn on the heater 258 during the cooling cycle or to generate a separate heat transfer fluid reciruclating loop. Therefore, the process is more efficient and less capital intensive.

It will be apparent to those skilled in the art that various changes may be made in the size, shape, type, number and arrangement of parts described hereinbefore. For example, although the freeze dryer system described hereinbefore utilizes the chambers in the hollow shelves as part of the conduit system by which heat transfer fluid is circulated through the system, other refrigeration systems may utilize hollow wall panels, coiled piping, or other forms of chambers in the conduit system for the heat transfer fluid. Various well-known refrigerants and heat transfer fluids may be utilized, as desired. The types of control valves described for use in the conduit system may be replaced by other suitable types. For sake of simplicity, certain check valves, steam valves, flowmeters, pressure transducers and thermocouples are not shown in the figures, but are fully appreciated by those skilled in the art. Accordingly, based on the foregoing, changes can be made without departing from the spirit of this invention and the scope of the appended claims. Alternative embodiments will be recognized by those skilled in the art and are intended to be included within the scope of the claims.

What is claimed is:

1. A method for controlling the temperature of a freeze drying chamber shelves and chamber in a refrigeration system having a condenser operatively associated therewith, said method comprising a) circulating a cryogen through said condenser;

b) circulating a cryogenically cooled heat transfer fluid through said chamber shelves for controlling the temperature therein, the temperature of said cryogenically cooled heat transfer fluid through said chamber shelves for controlling the temperature therein, the temperature of said cryogenically cooled heat transfer fluid having been regulated by an exchange of heat with said cryogen;

c) maintaining the temperature of said cryogenically cooled heat transfer fluid in a refrigeration recovery unit; and d) receiving said cryogenically cooled heat transfer fluid.

2. The method of claim 1 wherein the temperature of said cryogenically cooled heat transfer fluid is regulated by said exchange of heat with said cryogen through a plurality of heat exchangers.

3. The method of claim 1 wherein the temperature of said cryogenically cooled heat transfer fluid is further regulated by passing said cryogenically cooled heat transfer fluid through a heating unit.

4. The method of claim 1 wherein said circulation of said cryogenically cooled heat transfer fluid is accomplished by using a plurality of pumps and valves.

5. The method of claim 1 wherein the temperature of said cryogenically cooled heat transfer fluid is partially regulated by passing said cryogenically cooled heat transfer fluid through a precooling medium.

6. The method of claim 5 wherein said cryogen comprises liquefied atmospheric gases.

7. The method of claim 1 further comprising recovering waste refrigeration from a vaporized cryogen using a refrigeration recovery unit.

8. The method of claim 7 further comprising storing said cryogenically cooled heat transfer fluid in said refrigeration recovery unit.

9. The method of claim 1 further comprising transferring heat between said cryogen and said cryogenically cooled heat transfer fluid as said cryogen passes through said refrigeration recovery unit.

10. The method of claim 9 further comprising passing a low boiling point refrigerant through said condenser, the temperature of said low boiling point refrigerant regulated by the cryogen and wherein said low boiling point refrigerant comprises a fluid selected from the group consisting of a hydrocarbon and fluorocarbon based fluid.

11. The method of claim 1 further comprising passing a low boiling point refrigerant through said condenser, the temperature of said low boiling point refrigerant regulated by said cryogen.

12. A method for freeze drying comprising a) crculating a cryogen through said condenser;

b) circulating a cryogenically cooled heat transfer fluid through said chamber shelves for controlling the temperature therein, the temperature of said cryogenically cooled heat transfer fluid having been regulated by an exchange of heat with said cryogen; and c) partially regulating the temperature of said cryogenically cooled heat transfer fluid through a precooling medium.

13. The method of claim 12 wherein plurality of heat exchangers is regulated by the heat load requirements of said freeze drying chamber.

14. The method of claim 12 wherein the temperature of said cryogenically cooled heat transfer fluid is further regulated by passing said cryogenically cooled heat transfer fluid through a heating unit.

15. The method of claim 12 wherein said circulation of said cryogenically cooled heat transfer fluid is accomplished by using a plurality of pumps and valves.

16. The method of claim 12 wherein the temperature of said cryogenically cooled heat transfer fluid is partially regulated by passing said cryogenically cooled heat transfer fluid through a precooling medium.

17. A freeze drying apparatus comprising a freeze drying chamber for subjecting substances to a freeze drying process in which moisture contained within the substances is frozen and sublimed into a vapor;

a series of shelves within said chamber, a condenser operatively associated with said freezing chamber for freezing said vapor and for accumulating said vapor in solid form, said condenser having at least one pass for receiving a cryogen for freezing said vapor;

a plurality of heat exchangers for exchanging heat between said cryogen and a cryogenically cooled heat transfer fluid;

a cryogenically cooled heat transfer fluid circuit in which the temperature of said cryogenically cooled heat transfer fluid is regulated by said plurality of heat exchangers, and in which said cryogenically cooled heat transfer fluid passes through said freeze drying chamber to freeze a substance by separating at least a portion of liquid therefrom;

a cryogen circuit in which the heat of said cryogen is transferred to said cryogenically cooled heat transfer fluid through said heat exchangers and said cryogen is passed through said condenser;

a plurality of valve means for regulating the flow of said cryogen; and at least one circulation means for circulating said cryogenically cooled heat transfer fluid through said cryogen circuit.

18. The apparatus of claim 17 wherein the temperature of said cryogenically cooled heat transfer fluid is partially regulated by transferring heat to said cryogenically cooled heat transfer fluid by a precooling medium.

19. The apparatus of claim 17 wherein the temperature of said cryogenically cooled heat transfer fluid is increased by passing said cryogenically cooled heat transfer fluid through a heating unit.

20. The apparatus of claim 17 further comprising a refrigeration recovery unit to maintain the temperature of said cryogenically cooled heat transfer fluid and to recycle said cryogenically cooled heat transfer fluid.

21. The apparatus of claim 17 further comprising a liquid refrigerant circuit for feeding said condenser.

22. The apparatus of claim 21 wherein said liquid refrigerant circuit comprises a fluid selected from the group consisting of a hydrocarbon and fluorocarbon based fluid.

* * * * *